US005798602A

United States Patent [19]

Gopanchuk et al.

[11] Patent Number: 5,798,602

[45] Date of Patent: Aug. 25, 1998

[54] PLASMA ACCELERATOR WITH CLOSED ELECTRON DRIFT

[75] Inventors: Vladimir Gopanchuk; Igor Sorokin, both of Kaliningrad, Russian Federation

[73] Assignee: Societe Nationale Industrielle et Aerospatial, France

[21] Appl. No.: 793,500

[22] PCT Filed: Aug. 25, 1994

[86] PCT No.: PCT/RU94/00208

§ 371 Date: Feb. 20, 1997

§ 102(e) Date: Feb. 20, 1997

[87] PCT Pub. No.: WO96/06518

PCT Pub. Date: Feb. 29, 1996

[51] Int. Cl.[6] ..... H01J 1/52

[52] U.S. Cl. ..... 313/359.1; 313/361.1

[58] Field of Search ..... 313/359.1, 361.1, 313/362.1; 315/111.41

[56] References Cited

U.S. PATENT DOCUMENTS 5,359,258 10/1994 Arkhipov et al. .

5,475,354 12/1995 Valentian et al. ..... 313/359.1

FOREIGN PATENT DOCUMENTS

0541309A1 5/1993 European Pat. Off. .

A11715183 4/1994 U.S.S.R. .

OTHER PUBLICATIONS

Grishin S.D., Leskov L.V. "Elektricheskie paketnye dvigateli kowmicheskikh apparatov", 1989, Mashinostroenie (Moscow), p. 143.

*Primary Examiner*—Sandra L. O'Shea

*Assistant Examiner*—Vip Patel

*Attorney, Agent, or Firm*—Evenson, McKeown, Edwards & Lenahan, P.L.L.C.

[57] ABSTRACT

The proposed accelerator comprises a magnetic system (2), having an external magnetic pole (10) and an internal magnetic pole (9) which are interconnected by a magnetic circuit (8), an outer magnetic screen (13), an inner magnetic screen (12), a central magnetizing coil (5) and external magnetizing coils (7). Besides, the accelerator has a discharge chamber (3) comprising a concave anode (18) encompassing magnetic force surfaces (25) of a ionization zone (22), a sectional gas distributor (26), an inner side wall (15) and an outer side wall (16), the internal surfaces (20) whereof in the ionization zone (22) are located at an angle to a longitudinal axis (A—A) of the accelerator.

4 Claims, 1 Drawing Sheet

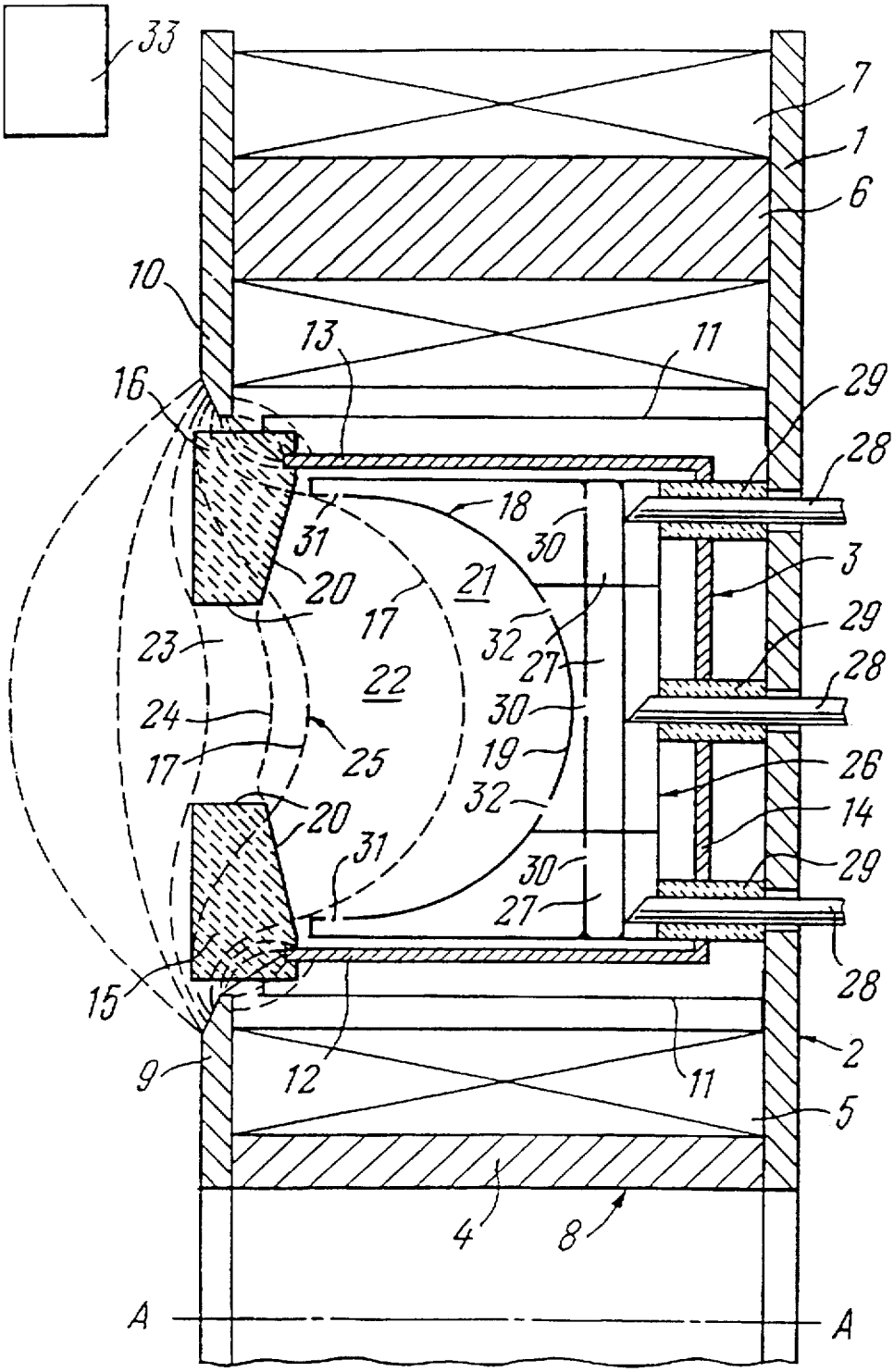
33
7
1
6
10
13
11
16
29
28
18
30
31
3
20
21
17
29
23
32
27
28
22
24
30
25
19
26
17
32
14
20
31
29
30
27
28
15
2
9
12
11
5
4
8
A
A

PLASMA ACCELERATOR WITH CLOSED ELECTRON DRIFT

FIELD OF TECHNOLOGY

This invention relates to the field of ion plasma technologies, specifically to a plasma accelerator with closed electron drift.

BACKGROUND ART

Known is a plasma accelerator with closed electron drift, designed for producing thrust on board spacecraft (C. D. Grishin, L. V. Leskov "Electrical rocket engines for spacecrafts" /Moscow/, Mashinostrojenie 1989, page 143).

The given accelerator contains an annular discharge chamber having side walls made of dielectrical material, and a channel, wherein a box-like anode is located, which is made as an integral unit with a gas distributor.

Besides, the accelerator comprises a magnetic system having magnetic poles located on both sides of the discharge chamber and interconnected by magnetic circuits with magnetizing coils, and a cathode-neutralizer.

The specified embodiment of the known accelerator provides ionization of the supplied operating gas by bombardment of electrons drifting within crossed radial magnetic and longitudinal electric fields. After ionization, some of the produced ions are accelerated in the electric field generated by difference of potentials built up between the cathode and the anode. The accelerated ion flow is being neutralized at the accelerator outlet by electrons coming from the cathode-neutralizer.

However, during ionization and acceleration a significant part of ions experience collisions against side walls of the discharge chamber, and this leads to ion recombination and, consequently, to energy losses. Besides, collison of the accelerated ions with walls at the outlet of the discharge chamber causes sputtering of the wall material and, hence, to a decrease in the accelerator life.

Also known is a plasma accelerator with closed electron drift (EP, AI, 0541309), having an annular discharge chamber defined by inner and outer circular side walls and having a channel including an operating gas ionization zone and a gas ion acceleration zone. In the discharge chamber channel there is a box-like anode—gas distributor located at the outlet of the discharge chamber at a distance which it not smaller than the distance between its side walls. Besides, the accelerator comprises a magnetic system having inner and outer magnetic poles interconnected by magnetic circuits with magnetic field sources mounted thereon an inner magnetic screen and an outer magnetic screens located on the external side of the discharge chamber close to its inner and outer side walls, respectively, with gaps relative to the corresponding magnetic poles, and a cathode-neutralizer.

The presence of the magnetic screens made it possible to arrange in the discharge chamber channel such a configuration of the magnetic field which significantly increases the gradient of its radial component. This enabled to decrease the length of the ionization zone and the acceleration zone and, correspondingly, to reduce the length of the discharge chamber side walls contacting ionized operating gas, and to increase slightly focusing effect on the accelerated ion flow by the force lines of magnetic field that are more concave at the acceleration zone inlet.

However, like also in the above described accelerator, a maximal concentration of operating gas ions occurs in the center of the discharge chamber at the inlet into the acceleration zone; and radial electric fields caused by the difference of ion concentrations in the center of the discharge chamber and in the nean-the-wall areas force out a significant part of ions to the side walls of the discharge chamber. It is obvious that energy losses on the walls in the ionization zone of the discharge chamber will decrease with a reduction in the ratio of the surface area of the side walls to the plasma volume between these walls. However, the specified design embodiment of the discharge chamber does not permit to reduce this ratio.

Besides, it is possible to decrease the mass average divergence angle of the accelerated ion beam and to reduce the share of partially accelerated ions impacting the side walls of the discharge chamber in the acceleration zone and leading to their significant erosion if the ion concentration is equalized across the width of the discharge chamber at the inlet into the acceleration zone. However, the above-mentioned design embodiment of the anode in said accelerator, namely its location at the same and significant distance from the ionization zone, makes it impossible to equalize ion concentration across the width of the discharge chamber at the inlet into the acceleration zone. Due to this the ion concentration gradient at the inlet into the acceleration zone causes a substantial ion flow towards the side walls of the discharge chamber—a factor which decreases the accelerator efficiency. Hereby, the radial electrical fields generated by this gradient is the inlet portion of the acceleration zone cause a de-focusing effect on the accelerated ion beam.

DISCLOSURE OF THE INVENTION

The purpose of the invention is to develop a plasma accelerator with closed electron drift, having such a discharge chamber, the mutual arrangement of which components would make it possible to decrease the length of its side walls contacting plasma and to equalize to a large degree the ion concentration across the width of the discharge chamber channel at the inlet into an acceleration zone, which would allow to increase efficiency and of the accelerator and improve the focusing of the accelerated ion beam.

This problem is solved by developing a plasma accelerator with closed electron drift, comprising an annular discharge chamber having an outer side wall and an inner side wall and a channel formed by internal surfaces of these walls and having a ionization zone for operating gas and an acceleration zone for ions of this gas, said zones being lpcated within the outlet portion of the discharge chamber, in a channel whereof on the side opposite to its outlet portion is placed an annular anode, behind which an annular gas distributor is located which has at least one channel for the supply of operating gas thereto and at least one channel for the supply of operating gas into the ionization zone of the channel of the discharge chamber connected with a magnetic system having an external magnetic pole mounted on the external side of the outer side wall of the discharge chamber approx. within its outlet portion and an internal magnetic pole mounted on the external side of the inenr side wall of the discharge chamber approx. within its outlet portion, said poles being interconnected by a magnetic circuit of the magnetic system having at least one magnetic field source to produce a certain configuration of magnetic force lines forming magnetic force surfaces in the discharge chamber, inside and outside of which are coaxially located annular magnetic screens interconnected by the magnetic circuit and placed correspondingly near to its outer and inner side walls with gaps relative to corresponding magnetic poles, thereby the accelerator has at least one cathode—neutralizer of accelerated ions of operating gas, wherein according to the invention, at least partially, the internal surfaces of the outer and inner side walls of the discharge chamber in the ionization zone are made at an angle to a longitudinal axis A—A of the accelerator, and an anode surface facing the ionization zone on the side of the outlet portion of the discharge chamber has a concave form encompassing the magnetic force surfaces of the ionization zone, thereby the edges of the concave surface of the anode are located in the area of the internal surfaces of the outer and inner side walls of the discharge chamber.

The conceptual possibility of decreasing the length of the discharge chamber wall surface in the ionization zone is connected with the fact that the width of this zone determined by the distance between the magnetic field surface at the beginning of the ion acceleration zone and the magnetic force surface, behind which the intensity of the magnetic field is already low enough for effective electron collection on the anode, is not the same across all the volume of this zone. This is determined directly by the configuration of the magnetic lens in the central part this distance is maximal, and closer to the near-the-wall areas, i.e. to the magnetic poles, it decreases. Thereby, the specified embodiment of the anode with the surface encompassing the ionization zone permits to decrease significantly the length of the discharge chamber side walls in this zone. Therewith, the specified embodiment of the anode does not hinder free drifting of electrons along the force surfaces of the magnetic field in the ionization zone and enables their collection on the anode in the most energy-efficient areas. Since such a design scheme of the discharge chamber enables to space apart the areas of operating gas supply and the areas of electron collection on the anode, there appears a possibility to ensure the gas supply in the areas remote from the central portion of the anode where the width of the ionization zone is smaller than in the center and becomes extremely narrow in the near-the-wall areas of this zone. Thereby, the gas supply to the anode areas which are located in the ionization zone where the width is small enough makes it possible to influence the distribution of ion concentration at the ionization zone outlet.

Thus, the proposed design of the discharge chamber provides for a possibility to decrease by several times the length of its side walls contacting plasma in the ionization zone and to increase plasma concentration in the near-the-wall areas at the acceleration zone inlet, which correspondingly results in a reduction of near-the-wall energy losses in plasma, improves the focusing of the accelerated ion flow and raises the accelerator efficiency.

In accelerators, the characteristic dimensions of which allow to use a discharge chamber with an optimal configuration, it is advantageous to have an angle between the internal surfaces of the outer and inner side walls of the discharge chamber in the ionization zone within the range of from 45 to 135 degrees.

It is evident that with such values of this angle the length of the side walls in the ionization zone is minimal, and the positive effects described above reveal themselves in the best way. Selection of a specific angle out of the above range is associated in each particular case, with a number of considerations, e.g. operating gas selected a requirements to plasma beam density, and the like. Thereby, if the angle is larger than 135 degrees or smaller than 45 degrees, the length of the side walls must be increased, which will result in growing of the near-the-wall energy losses, thus leading to a reduction of the accelerator efficiency.

In accelerators with small characteristic dimensions, it is desirable, that the magnetic circuit, interconnecting the annular magnetic screens would constitute a magneto-conductive bridge connecting directly the screen ends, located on the side opposite to the outlet portion of the discharge chamber the magnetic screens must be therewith insulated from the components of the magnetic system.

In accelerators with small characteristic dimensions, a situation may occur, when the width of the ionization zone in the near-the-wall area is commensurate with or less than the length of actual ionization of operating gas neutral atoms entering this zone. Therefore, in order to enlarge this zone, it is practical to locate the anode surface as close as possible to the magnetic screens which, in their design, restrict the possibility of increasing the width of the discharge chamber. In this regard, the proposed technical solution is a version, wherein the magnetic screens themselves are a part of the discharge chamber body and can therefore be at anodic or floating anodic potential.

It is favourable that the gas distributor would comprise three isolated sections, each having a channel for the supply of operating gas therein and a channel for the supply of operating gas into the ionization zone and the anode would have four channels for the supply of operating gas into the ionization zone, two channels thereof being located near the edges of the concave surface of the anode and connected with the channel of the section corresponding to each of them, and two other channels being located in the area of the concave surface of the anode, said surface being remote from the inlet portion of the discharge chamber said other channels being connected with the channel of the third isolated section of the gas distributor.

Use of additional channels to supply operating gas into the discharge chamber provides for an optimal plasma density distribution across the width of the discharge chamber at the inlet the acceleration zone, whereby maximum efficiency and the best focusing of the accelerated ion beam are achieved. The optimal plasma concentration distribution becomes possible due to superposition of ion flows from central and periphery portions of the ionization zone, where the corresponding channels of operating gas supply are located, by selecting flow rate ratios of operating gas supplied into the channels delivering gas to the corresponding sections of the gas distributor. Use of such design embodiment is especially effective with a multi-mode accelerator, where it is necessary to optimize its operation.

Thus, use of the proposed invention permits to decrease the length of the discharge chamber side walls contacting plasma and to equalize substantially the ion concentration across the width of the discharge chamber channel at the inlet to the acceleration zone, which allows to increase the accelerator efficiency and life and improve the focusing of the accelerated ion beam.

BRIEF DESCRIPTION OF THE DRAWING

The advantages of this invention will be more clear from the following example of its embodiment and the accompanying figure showing schematically a longitudinal cross-section of a plasma accelerator with closed electron drift made in accordance with the invention.

PREFERRED EMBODIMENT OF THE INVENTION

The plasma accelerator with closed electron drift made in accordance with the invention and presented in the figure comprises a bearing flange 1, whereon all the components of a magnetic system 2 and a discharge chamber 3 are mounted. To the central portion of the flange 1 is attached a core 4 of a central magnetizing coil 5, which is an internal source of the magnetic field, and at the periphery portion of the flange 1 are mounted four, equally spaced cores 6 of external magnetizing coils 7 which are external sources of the magnetic field. The flange 1, the core 4 and the cores 6 are components of a magnetic circuit 8 interconnecting an internal magnetic pole 9 and an external magnetic pole 10, and constitute a single bearing framework. The central magnetizing coil 5 is connected in series with the external magnetizing coils 7, and they constitute a magnetic field source in the discharge chamber 3. On the internal and external and sides, the discharge chamber 3 is fixed to the flange 1 by means of bearing rings 11. Bearing parts in the discharge chamber 3 are: a inner magnetic screen 12 and on outer magnetic screen 13 interconnected by a magneto conductive bridge 14 constituting a magnetic circuit. To the inner magnetic screen 12 is attached an inner side wall 15 of the discharge chamber 3, the wall being placed outside of the internal magnetic pole 9, between which pole and the inner magnetic screen 12 there is a certain gap. In the same way, to the outer magnetic screen 13 is attached an outer side wall 16 of the discharge chamber 3, the wall being placed inside of the external magnetic pole 10, between which pole and the outer magnetic screen 13 there is also a certain gap. Thus, the inner magnetic screen 12, the outer magnetic screen 13 and the magneto conductive bridge 14 interconnecting them are at the same time both a bearing body of the discharge chamber 3 and a component of the magnetic system 2, thus providing for the topology of the magnetic field force lines in the discharge chamber 3 as necessary for effective operation of the plasma accelerator.

Immediately between the inner magnetic screen 12 and the outer magnetic screen 13 is located an anode 18, a surface 19 of which, as viewed from the outlet portion of the discharge chamber 3, has a concave form, therewith the edges of the concave surface 19 of the anode 18 are located in the area of internal surfaces 20 of the inner side wall 15 and the outer side wall 16 of the discharge chamber 3. These surfaces 20 and the concave surface 19 of the anode 18 form a channel 21 of the discharge chamber 3, wherein directly both ionization and acceleration of operating gas take place. Here, a ionization zone 22 is located in the channel 21 on the side of the anode 18 and bounded by the concave surface 19 of the anode 18, by the internal surfaces 20 of the side walls 15, 16 arranged in this ionization zone 22 at an angle of e.g., 100 degrees to an accelerator axis A—A, and by the border with a ion acceleration zone 23 which is arbitrarily presented as an equipotential line 24 of the electric field, which like being based on a particular magnetic force surface 25 formed by the force lines 17 of the magnetic field.

The given configuration of the channel 21 in the ionization zone 22 permits to minimize the length of the internal surfaces 20 of the side walls 15, 16 of the discharge chamber 3 in the channel 21 and, consequently, to reduce energy losses related to ion recombination on these surfaces 20. Besides, the specified configuration of the channel 21 allows to increase of the ion concentration in the near-the-wall sections of the equipotential line 24 of the electric field, the line bordering the acceleration zone 23, and this leads to an improvement in the focusing of the accelerated ion beam.

Therewith, the internal surfaces 20 of the outer and inner walls 16, 15 of the discharge chamber 3 that are located in the ionization zone 22, can be made at any angle to the longitudinal axis A—A of the accelerator. The magnitude of this angle depends on a number of factors, e.g., on the selection of operating gas, on the requirements to the ion beam density and the like. Thereby, from the standpoint of the accelerator the most optimal angles are from 45 to 135 degrees.

The ion acceleration zone 23 is located in the outlet portion of the discharge chamber 3 and bounded on one side arbitrarily by the equipotential line 24 of the electric field and by the internal surfaces 20 of the inner and outer side walls 15, 16 constituting the borders of the channel 21, which have a cylindrical form in this acceleration zone 23 and placed coaxially relative to each other. Between the anode 18 and the magneto conductive bridge 14 is mounted a gas distributor 26 with three independent sections 27 rigidly connected with the anode 18. Each section 27 of the gas distributor 26 has channels 28 to supply operating gas thereto which are made in the form of metal tubes electrically insulated from the components of the magnetic system 2 by means of ceramic sleeves 29, and channels 30 to supply operating gas into the ionization zone 22. Therewith the anode 18 is provided with two channels 31 to supply operating gas into the ionization zone 22 which are located in that portion of the anode 18, which is remote from the outlet portion of the discharge chamber 3. Each of the channels 31 for the supply gas of operating is in communication with one of the channel 30 for the supply of operating gas to the section 27 of the gas distributor 26 corresponding thereto.

The above described scheme of the supply of operating gas into the ionization zone 22 allows to control the ion distribution superposition at the inlet into the acceleration zone 23 the ions coming both from the depth of the channel 21 and from the near-the-wall areas of the ionization zone 22. This permits to regulate the focusing of the accelerated ion beam in different operation modes of the plasma accelerator.

On the plasma accelerator, beyond the discharge chamber 3 at its outlet portion, there is mounted a cathode—neutralizer 33.

In another embodiment of this invention the gas distributor is not separated into sections, thereby it can have at least one channel for the supply of operating gas thereto and at least one channel for the supply of operating gas into the ionization zone 22 of the discharge chamber 3.

The proposed plasma accelerator with closed electron drift operates in the following way.

Since the principle of operation of the proposed plasma accelerator is similar to that of the already known accelerators of the same type, in the description of operation of the proposed accelerator we shall dwell only upon the influence of the technical solutions proposed in this invention on its operation.

The magnetic flow produced by the central magnetizing coil 5 connected in series with the four external magnetizing coils 7 is closed successively through the internal magnetic pole 9, the core 4, the flange 1, the core 6 and the external magnetic pole 10, as well as, partially, through the outer magnetic screen 13, the magneto conductive bridge 14 and the internal magnetic pole 12 and creates in the channel 21 of the discharge chamber 3 such a distribution topology of the magnetic field, mainly directed radially that is optimal for operation of the plasma accelerator. The potential difference applied between the anode 18 and the cathode—neutralizer 33 generates an axial electric field in the channel 21 of the accelerator. The operating gas (any gas can be used if intended for the same purposes enters the sectional gas distributor 26 through the supply channels 28, with a certain mass flow rate for each section 27.

At the outlet from the sections 27 the gas, having been distributed uniformly in the azimuth direction, enters the ionization zone 22 of the discharge chamber 3 through the supply channels 30, the channels 31 and the channels 32 extending across the anode 18.

For the sake of simplicity we shall describe in turn the dynamics of the electron and ion components of plasma, beginning from the accelerator start-up.

During the accelerator starting, the electrons emitted by the cathode—neutralizer 33 enter the discharge chamber 3 under the influence of the electric field, where they find their way to the magnetic field area. In the crossed radial magnetic and axial electric fields the electrons start drifting in the azimuth direction in the channel 21, thereby diffusing towards the anode and scattering over the surfaces 20 of the inner side wall 15 and the outer side wall 16 of the discharge chamber 3. In the course of diffusion the electrons, while falling through the potential difference between the anode 18 and the cathode—neutralizer 33, build up the energy sufficient for ionization by electron bombardment of the neutral atoms of operating gas, which enter the ionization zone 22. During the stationary operation of the accelerator the main part of the electrons emitted by the cathode—neutralizer 33 neutralize the space charge of the ions accelerated in the channel 21, and about 10–20% of electrons diffuse towards the anode and participate in ionization processes. Since the surfaces 20 in the ionization zone 22 at their approach to the anode 18, due to their location at an angle to the longitudinal axis A—A of the accelerator, extend into the area of a sufficiently strong field the effect of "magnetic plug" connected with this hinders the electrons reaching the surface 20 of the side walls 15, 16 and decreases the near-the-wall diffusion of electrons. This causes a reduction in the electron diffusion counterflow, which makes up a part of energy losses in the accelerator.

The operating gas ions produced in the ionization zone under the influence of electron pressure scatter to the borders of this zone. Having reached the surface 20 of the walls 15, 16, the ions, as a rule recombine and require a repeated energy input for ionization, and since the length of the above-mentioned surfaces 20 is significantly decreased, consequently, the energy losses in the accelerator are also reduced. That portion of the ions which enter the acceleration zone 23, are accelerated therein and leave the accelerator.

It is evident that the percentage of ions reaching the surfaces 20 of the walls 15, 16 located in the acceleration zone 23 will be the lower, the more uniform the ion concentration will be distributed across the width of the channel 21 at the inlet into the acceleration zone 23. It is precisely this what is achieved by an additional supply of operating gas into the near-the-wall areas of the ionization zone 22 through the channels 31.

Thus, by redistributing the flow rate of operating gas over the channels 28 supplying gas to the sections 27 of the gas distributor 26 and, correspondingly, its feed to the near-the-wall areas of the ionization zone 22 through the channels 31 as well as to the central part of the ionization zone 22 through the channels 32, it is possible to select an optimal operation mode of the accelerator with the highest efficiency and the longest life.

Besides, the possibility of autonomous control over the supply of operating gas to different areas of the ionization zone 22 allows to vary the ion beam focusing mode, and this is especially important in technological processes, and also to maintain the optimal ion beam focusing and efficiency when varying the operation mode in multi-mode accelerators.

INDUSTRIAL APPLICABILITY

The present invention can be used in the most effective way in electric propulsion systems of spacecrafts as propulsion devices with high specific impulses as well as in the field of technologies of plasma treatment of materials, e.g., in processes of ionic cleaning of dry etched surfaces, spraying and the like. Besides, this invention can be used in various fields of application of plasma accelerators, e.g., in astrophysical experiments as a highly effective source of artificial plasma generation.

What is claimed is:

1. A plasma accelerator with closed electron drift, comprising an annular discharge chamber (3) having an outer side wall (16) and an inner side wall (15) and a channel (21) formed by internal surfaces (20) of these walls (15, 16) and having a ionization zone (22) for operating gas and an acceleration zone (23) for ions of this gas said zones being located within the outlet portion of the discharge chamber (3), in a channel (21) whereof on the side opposite to its outlet portion is placed an annular anode (18), behind which an annular gas distributor (26) is located which has at least one channel (28) for the supply of operating gas thereto and at least one channel (30) for the supply of operating gas into the ionization zone (22) of the channel (21) of the discharge chamber (3) connected with a magnetic system (2) having an external magnetic pole (10) mounted on the external side of the outer side wall (16) of the discharge chamber (3) approximately within its oulet portion, and an internal magnetic pole (9) mounted on the external side of the inner side wall (15) of the discharge chamber (3) approximately within its outlet portion, said poles being interconnected by a magnetic circuit (8) of the magnetic system (2) having at least one magnetic field source to produce a certain configuration of magnetic force lines (17) forming magnetic force surfaces (25) in the discharge chamber (3), inside and outside of which are coaxially located annular magnetic screens (12, 13) interconnected by the magnetic circuit and placed correspondingly near to its outer and inner side walls (16, 15) with gaps relative to corresponding magnetic poles (10, 9), thereby the accelerator has at least one cathode—neutralizer (33) of accelerated ions of operating gas, wherein, at least partially the internal surfaces (20) of the outer and inner side walls (16, 15) of the discharge chamber (3) in the ionization zone (22) are made at an angle to a longitudinal axis (A—A) of the accelerator and an anode (18) surface (19) facing the ionization zone (22) on the side of the outlet portion of the discharge chamber (3) has a concave form encompassing the magnetic force surfaces (25) of the ionization zone (22), thereby, the edges of the concave surface (19) of the anode (18) are located in the area of the internal surfaces (20) of the outer and inner side walls (16, 15) of the discharge chamber (3).

2. The accelerator of claim 1, wherein:

an angle between the internal surfaces (20) of the outer and inner side walls (16, 15) of the discharge chamber (3) in the ionization zone (22) is within the range of from 45 to 135 degrees.

3. The accelerator of claim 2, wherein:

the magnetic circuit interconnecting the annular magnetic screens (12, 13) constitutes a magneto conductive bridge (14) connecting directly the ends of the screens (12, 13) said ends being located on the side opposite to the outlet portion of the discharge chamber (3), the magnetic screens (12, 13) are therewith insulated from the components of the magnetic system, (2).

4. The accelerator of claim 2, wherein:

the gas distributor (26) comprises there isolated sections (27), each having a channel (28) for the supply of operating gas therein and a channel (30) for the supply of operating gas into the ionization zone (22), and the anode (18) has four channels (31, 32) for the supply of operating gas into the ionization zone (22), two channels (31) thereof being located near the edges of the concave surface (19) of the anode (18) and connected with the channel (30) of the section (27) corresponding to each of them, and two other channels (32) being located in the area of the concave surface (19) of the anode (18), said surface being remote from the inlet portion of the discharge chamber (3), said other channels being connected with the channel (30) of the third isolated section (27) of the gas distributor (26).

* * * * *

UNITED STATES PATENT AND TRADEMARK OFFICE

CERTIFICATE OF CORRECTION

PATENT NO. : 5,798,602

DATED : August 25, 1998

INVENTOR(S) : Vladimir V. Gopanchuk et al.

It is certified that error appears in the above-identified patent and that said Letters Patent is hereby corrected as shown below:

On the title page item [73], should read

--Aerospatiale Societe Nationale Industrielle--.

Signed and Sealed this

Seventeenth Day of August, 1999

*Attest:*

Q. TODD DICKINSON

*Attesting Officer*

*Acting Commissioner of Patents and Trademarks*